United States Patent [19]

Shaffer

[11] 4,302,182

[45] Nov. 24, 1981

[54] PHOTOFLASH LAMP

[75] Inventor: John W. Shaffer, Williamsport, Pa.

[73] Assignee: GTE Products Corporation, Stamford, Conn.

[21] Appl. No.: 86,502

[22] Filed: Oct. 19, 1979

[51] Int. Cl.[3] ..... F21K 5/00

[52] U.S. Cl. ..... 431/362

[58] Field of Search ..... 431/362

[56] References Cited

U.S. PATENT DOCUMENTS 3,041,862 7/1962 Anderson et al. ..... 431/362

3,752,636 8/1973 Warninck ..... 431/362

*Primary Examiner*—Carroll B. Dority, Jr

*Attorney, Agent, or Firm*—Edward J. Coleman

[57] ABSTRACT

A high-voltage type photoflash lamp having an ignition structure including an improved primer material for the reliable ignition of filamentary combustible material distributed within the oxygen-filled envelope of the lamp. The primer material comprises, a particulate fuel such as zirconium powder, an oxidizer salt such as potassium perchlorate, a binding agent such as nitrocellulose, a finely divided inert material such as fumed alumina, and an additive of conductive fibers for controlling breakdown voltage. A preferred additive comprises finely milled or chopped fibers of carbon or graphite.

10 Claims, 2 Drawing Figures

PHOTOFLASH LAMP

BACKGROUND OF THE INVENTION

This invention relates to photoflash lamps and, more particularly, to flashlamps of the type containing primer material ignited by a high voltage pulse.

Such flashlamps typically comprise a tubular glass envelope constricted and tipped off at one end and closed at the other end by a press seal. A pair of lead-in wires pass through the glass press and terminate in an ignition structure including a glass bead, one or more glass sleeves, or a glass resevoir of some type. A mass of primer material contained on the bead, sleeve, or resevoir bridges across and contacts the ends of the lead-in wires. Also disposed within the lamp envelope is a quantity of filamentary metalic combustible, such as shredded zirconium or hafnium foil, and a combustion-supporting gas, such as oxygen, at an initial fill pressure of several atmospheres.

An improved ignition structure, which provides excellent lamp reliability and substantial economies and ease of automated manufacture, is the so-called fritted lead construction described in U.S. Pat. No. 4,059,389, of Donald E. Armstrong et al. This is a beadless ignition structure comprising a pair of spaced-apart lead-in wires, and a coating of primer material over the frit-coated terminations. The primer may bridge the wire terminations or comprise separate spaced-apart coatings on the respective terminations with the filamentary combustible (shredded foil) being in contact with both terminations to provide a conducting path therebetween.

Although the aforementioned fritted lead construction provides a number of advantages, there are problem areas that may arise. For example, if the primer is bridged from lead to lead, expansion differentials from heating to cooling during manufacture sometimes cause the primer bridge to crack open sufficiently so that the high voltage pulse will not jump the gap to flash the lamp. If the lamp is made with separate primer-coated leads, it is necessary that the combustible shreds within the lamp contact both primer-coated lead ends to complete the circuit path. In actual practice the combustible distribution may occasionally be wadded and located such that it does not make good contact with the primer-coated lead ends and, thus, result in a lamp that fails to flash. To overcome these problems, copending application Ser. No. 971,775, filed Dec. 21, 1978, now U.S. Pat. No. 4,270,897, issued June 2, 1981, and assigned to the present assignee, describes an ignition structure comprising a pair of spaced apart metal lead-in wires sealed in one end of the glass envelope of a lamp, with the glass-sealed wires extending inside the envelope and the metal terminations of each wire within the envelope being bare of the sealing glass. In a preferred embodiment, the envelope glass protrudes inside the envelope and the lead-in wires are sealed within this protruding glass portion in a predetermined spaced-apart relationship, the protruding glass having a stretched configuration from the lead-in wires having been pushed through the end of the envelope during heat sealing. Preferably, each of the lead-in wire terminations has the configuration of a transverse cut having a substantially flat end surface, with each of the flat end surfaces being bare of glass and substantially flush with the surrounding glass surfaces. The primer material is then coated about the inner end of the protruding portion of glass within the envelope so as to cover and bridge the terminations. This construction provides a supported circuit path from lead to lead which will not crack apart due to the solid glass coating covering and supporting both internal leads; further, this construction is independent of combustible contact to complete the flashing circuit.

This pushed-through-lead structure also provides a comparatively higher ignition breakdown voltage. Although a uniformly high breakdown voltage is generally a desirable feature, this type of lamp construction requires primer modification to provide flashlamp array electrical breakdown voltages that do not exceed that provided by the minimum output of cameras on the market, e.g. about 2,000 volts. Capacitance inherent in multilamp photoflash arrays, such as that described in U.S. Pat. No. 4,164,007, reduces the actual voltage applied to the lamps therein to a value as low as 1,800 volts. Lamps with a firing or breakdown voltage above that available will fail to flash. Typical primer material formulations as used in more conventional high voltage flashlamps, e.g., such as the primer compositions described in U.S. Pat. No. 4,059,388 and copending applications Ser. No. 744,540, filed Nov. 24, 1976, and Ser. No. 865,987, filed Dec. 30, 1977, now U.S. Pat. No. 4,190,413 issued Feb. 26, 1980 both assigned to the present assignee, will, when used in lamps such as the pushed-through-lead type, give firing voltages that are too high for reliable operation.

With respect to U.S. Pat. No. 4,059,389 a primer composition is described which comprises about 99.0% by weight zirconium powder and 1.0% by weight cellulose nitrate on a dry basis. In application Ser. No. 744,540, an additive of finely divided inert material, such as fumed silica, fumed alumina or fumed titania, is included in the mixture to enhance the sensitivity and reliability of the primer material. In application Ser. No. 865,987, an additive of relatively coarse electrically nonconducting inert particulate material, such as glass microbeads, is included in the primer mixture to elevate both the average and low limit of the primer breakdown voltage.

SUMMARY OF THE INVENTION

In view of the foregoing, it is an object of this invention to provide an improved photoflash lamp with a reliable ignition means having more controlled lamp breakdown voltage characteristics.

A particular object of the invention is to provide a primer for high voltage type photoflash lamps that exhibits a more controlled breakdown voltage range with a substantially reduced incidence of lamps having undesirably high breakdown voltages, while maintaining good flash reliability.

These and other objects, advantages and features are attained in accordance with the principals of this invention, by the discovery that the addition of finely milled or chopped, electrically conductive fibers, such as carbon or graphite, to the primer of high voltage flashlamps permits control of maximum breakdown voltage so as to avoid lamp failures caused by low camera output voltages.

The primer according to the invention is particularly useful with the aforementioned pushed-through-lead construction wherein spaced apart metal lead-in wires are sealed in one end of the glass envelope so that the glass sealed wires extend inside the envelope with the metal terminations of each wire being bare of sealing glass and substantially flush with the surrounding glass surface. The primer material is coated about the inner end of the glass sealed extension of the lead-in wires in a manner covering and bridging the bare metal terminations. The primer composition comprises a mixture of a particulate fuel, such as zirconium, a binding agent such as introcellulose, and the additive of conductive fibers. The primer composition may also include an oxidizer such as potassium perchlorate and a finely divided inert material, such as fumed alumina. The average length of the fibers and the weight percent of the fiber additive in the mixture are selected to control the breakdown voltage of the primer to a desirable level.

BRIEF DESCRIPTION OF THE DRAWINGS

This invention will be more fully described hereinafter in conjunction with the accompanying drawings, in which.

DESCRIPTION OF PREFERRED EMBODIMENT

Figure 1:
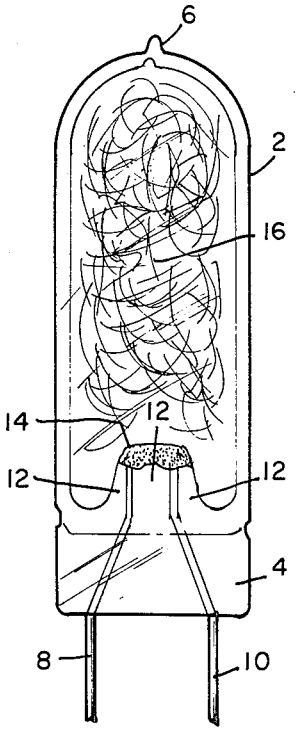
FIG. 1 is an elevational view of a photoflash lamp made in accordance with the invention.
Figure 2:
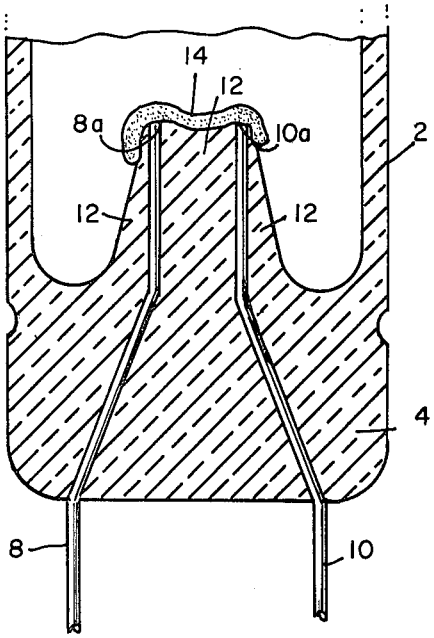
FIG. 2 is a fragmentary vertical sectional view on an enlarged scale of the in-lead and ignition means construction of the lamp of FIG. 1.

Referring to FIGS. 1 and 2, the high-voltage type flashlamp illustrated therein is similar to that described in the aforementioned copending application Ser. No. 971,775 except for the composition of the primer material, as will be described hereinafter. The lamp comprises an hermetically sealed light-transmitting envelope 2 of glass tubing having a pinch-seal 4 defining one end thereof and an exhaust tip 6 defining the other end thereof. Supported by the seal 4 is an ignition means including a pair of metal lead-in wires 8 and 10 extending into the envelope 2. A portion 12 of the envelope glass at the seal 4 end thereof protrudes inside the envelope, and the lead-in wires 8 and 10 are sealed within the protruding portion 12 in a predetermined spaced-apart relationship with the respective terminations 8*a* and 10*a* of the wires 8 and 10 being bare of sealing glass. Preferably, each of the wire terminations 8*a* and 10*a* has the configuration of a transverse cut having a substantially flat end surface. In addition to being bare of sealing glass, these flat end surfaces 8*a* and 10*a* are substantially flush with the surrounding glass surface of portion 12.

The ignition structure is completed by a coating of primer material 14 about the inner end of the glass prtruding portion 12. More specifically, the primer coating 14 covers and bridges the bare metal terminations 8*a* and 10*a* of lead-in wire 8 and 10 by coating the web of glass between the upper portions of the lead-in wires. This provides a supported circuit path from lead to lead which will not crack apart in view of the solid glass coating (portion 12) covering and supporting both internal leads. Further, this supported primer bridge provides a circuit path which is independent of combustible shred contact to complete the flashing circuit. Ignition breakdown voltage can be controlled, in part, by selective predetermination of the spacing between the lead-in wire terminations 8*a* and 10*a*.

Typically, the lamp envelope 2 has an internal diameter of less than one-half inch and an internal volume of less than one cubic centimeter. A quantity of filamentary combustible fill material 16, such as shredded zirconium or hafnium foil, is disposed within the lamp envelope. The envelope 2 is also provided with a filling of combustion-supporting gas, such as oxygen, at a pressure of several atmospheres. Typically, the exterior surface of the glass envelope 2 is also provided with a protective coating, such as cellulose acetate (not shown).

Operation of such high voltage flashlamps is initiated when a high voltage pulse from, e.g., a piezoelectric crystal, is applied across the two lead-in wires 8 and 10. A spark discharge occurs through the primer bridge 14, and electrical breakdown of the primer causes its deflagration which, in turn, ignites the shredded metallic combustible 16. The fully insulating glass coating on the lead, with only necessary exposure of bare metal for ignition, provides a unique, reliable means for providing an open circuit after flashing.

In one specific embodiment of the invention, a high voltage flashlamp of the type shown in FIG. 1 was provided with an envelope 2 formed from 0.3 inch O.D. tubing of Corning G-1 type soft glass having a coefficient of thermal expansion within the range of 85 to $95\times10^{-7}$ in./in./°C. between 20° C. and 300° C. The internal volume was 0.4 $cm^3$; the quantity of combustible material was 12.5 mgs. of four-inch long zirconium shreds having a cross section of $0.008\times0.0018$ inch; the oxygen fill pressure was 725 cm. Hg absolute. The lead-in wires 8 and 10 were 0.014 inch in diameter and formed of Dumet wire to provide the desired glass-to-metal expansion match. Alternatively, the above lamps have also been made using lead-in wires formed of a nickel-iron alloy referred to as 52 alloy which has a mean coefficient of thermal expansion of about $101.0\times10^{-7}$ in./in./°C. between 25° C. and 300° C. The terminations of the wires were provided by a standard transverse cut to provide flat end surfaces. A high voltage capacitor discharge method was employed for removing the seal glass from wire terminations 8*a* and 10*a*, and approximately 2 mgs. of primer 14 was used for each lamp. The end of the protruding glass portion 12 was dip-coated with the primer to provide an average thickness of 2 to 3 mils and the coverage illustrated in FIGS. 1 and 2. A protective coating of cellulose acetate lacquer was provided on the exterior of the envelope.

In accordance with the present invention, I have discovered that a reliable primer, particularly useful with this type lamp construction, can be provided by the use of an additive of conductive fibers. More specifically, by appropriate selection of the average length and weight percent of a fiber additive, such as finely milled or chopped carbon or graphite fibers, the maximum breakdown voltage of the primer material can be controlled so as to avoid lamp failures caused by low camera output voltages. For example, primer material 14 may be provided by mixing a particulate fuel, typically a combustible metal powder such as zirconium, with an additive of conductive fibers, and a binding agent such as nitrocellulose in a suitable solvent. The resulting primer mixture is then applied, as described above, such as by a dip process.

Fibers of either amorphous or graphitic carbon are known to industry as strong, high modulus reinforcement materials for composite plastic structures and are used in commercial items such as golf clubs. Fiber diameters are typically in the range from about 7 to 20 micrometers. For the purposes of this invention, the fibers are chopped or milled so as to give an average fiber length of from about 0.05 to 1.0 millimeter. The average fiber length should be less than the dimensional spacing between the electrical points of contact to the primer coating to prevent short circuiting of the primer structure. With sufficient lead wire tip spacing, average fiber lengths of 3 millimeters may be used.

The breakdown voltage control attained by such use of chopped or milled carbon or graphite fibers is applicable to primers using either aqueous or organic solvent type primers without giving rise to viscosity instability, foaming, or other evidences of chemical incompatibility. Breakdown voltage control is achieved by selection of average fiber length and weight percent of fiber used in the primer formulation. The weight percent may vary from 0.2 to 10.0 percent by weight on a dried basis, but a range of 1.5 to 3.5 percent is preferred.

By way of specific illustrative example, lamps of the type illustrated in FIG. 1 and specifically described hereinbefore were prepared using a control primer having the following dried composition: 83.93% powdered zirconium, 10.05% potassium perchlorate, 2.00% nitrocellulose, and 4.02% fumed alumina. This primer was reduced to 59.26% non-volatiles for application, using 2-butoxyethyl acetate and methyl isobutyl ketone as solvents. A first test primer was prepared by adding 1.00% (by weight of the above primer fluid) of chopped graphite fiber (having a mean fiber length of 0.1 millimeter) giving 1.66% carbon fiber on an as-dried basis. In like manner, a second test primer was prepared by adding 2.00% (by weight) chopped graphite fiber to the fluid control primer giving 3.32% fiber on a dried basis. The fiber used was obtained from Mitsubishi International Corp., 227 Park Avenue, New York, NY 10017. The lamps were flashed and the breakdown voltages recorded.

| | % Fiber (dried primer) | No. Lamps | Avg. Bkdn. V. | Avg. Bkdn. V. |
|---|---|---|---|---|
| Control | 0 | 62 | 1350 | 2200 |
| Test 1 | 1.66 | 76 | 750 | 1400 |
| Test 2 | 3.32 | 75 | 536 | 900 |

This test dramatically illustrates the effectiveness of carbon or graphite fibers on the lamp breakdown voltage. Further, the relative chemical inertness and the low density of fine, carbon or graphite fibers renders them particularly suitable to provide a stable primer fluid free of problems caused by changes in viscosity or rapid settling of particles.

Alternatives are the use of short-length, metallic shreds or fibers. While many metals could, in principle, be used, those which are relatively corrosion-resistant, such as titanium, zirconium hafnium, and various alloys, such as the stainless steels, would appear to be most feasible. A low-density metal, such as titanium, would offer advantages in settling rate over more dense materials, like zirconium. It is also possible to provide an electrically conductive coating on nonconductive fibers, such as glass or ceramic fibers, etc., and to use such coated fibers to achieve the purposes of this invention. Glass fibers could be rendered surface-conductive by a film of indium or tin oxide, or by coating with a metal such as, e.g., silver.

Hence, although the invention has been described with respect to a specific embodiment, it will be appreciated that modifications and changes may be made by those skilled in the art without departing from the true spirit and scope of the invention.

What is claimed is:

1. A photoflash lamp comprising:
an hermetically sealed, light-transmitting envelope;
a quantity of filamentary combustible material located within said envelope;
a combustion-supporting gas in said envelope; and
high voltage breakdown ignition means disposed in said envelope in operative relationship with respect to said filamentary combustible material, said ignition means including a pair of lead-in wires extending into said envelope in a spaced relationship, and primer material covering and bridging the terminations of said lead-in wires within said envelope, said primer material comprising a mixture of particulate fuel, a binding agent, and an additive of conductive fibers in an amount of from about 0.2 to 10.0 percent by weight of said primer mixture on a dried basis, whereby the breakdown voltage of said primer material is controlled by selection of the average length of said fibers and the weight percent of fiber additive in said mixture.

2. The lamp of claim 1 wherein said combustion-supporting gas in said envelope is oxygen at an initial fill pressure exceeding one atmosphere.

3. The lamp of claim 1 wherein said fuel is a combustible metal powder.

4. The lamp of claim 3 wherein said fuel is zirconium powder.

5. The lamp of claim 1 wherein said additive of conductive fibers is present in said primer material mixture in an amount of from about 1.5 to 3.5 percent by weight on a dried basis.

6. The lamp of claim 1 wherein the average length of said conductive fibers is about 0.05 to 3.0 millimeters and the average diameter of said fibers is in the range of 7 to 20 micrometers.

7. The lamp of claim 6 wherein the average length of said conductive fibers is from about 0.05 to 1.0 millimeter.

8. The lamp of claim 1 wherein said additive comprises carbon or graphite fibers.

9. The lamp of claim 1 wherein said envelope is glass, said lead-in wires are metal and sealed in one end of said glass envelope, said glass-sealed pair of lead-in wires extend inside said envelope with the metal termination of each of said lead-in wires within said envelope being bare of said sealing glass, the metal surface of each of said bare terminations being substantially flush with the surrounding sealing glass surface, and said primer material is coated about the inner end of the glass-sealed extension of said lead-in wires in a manner covering and bridging said bare metal terminations.

10. The lamp of claim 1 wherein said primer material mixture further includes an oxidizer salt and a finely divided inert material.

* * * * *